US007014184B2

(12) United States Patent
Hall et al.

(10) Patent No.: US 7,014,184 B2
(45) Date of Patent: Mar. 21, 2006

(54) SYSTEMS, DEVICES, AND METHODS FOR FEEDING SHEET MATERIAL TO A DISK SEPARATOR

(75) Inventors: David F. Hall, Plattsburgh, NY (US); Thomas Venne, Champlain, NY (US)

(73) Assignee: Prim Hall Enterprises Inc., Plattsburgh, NY (US)

( * ) Notice: Subject to any disclaimer, the term of this patent is extended or adjusted under 35 U.S.C. 154(b) by 206 days.

(21) Appl. No.: 10/426,198

(22) Filed: Apr. 30, 2003

(65) Prior Publication Data

US 2004/0217544 A1 Nov. 4, 2004

(51) Int. Cl.
*B65H 3/00* (2006.01)

(52) U.S. Cl. ..... 271/3.02; 414/788.9

(58) Field of Classification Search ..... 271/3.02, 271/233, 241, 220, 3.03; 414/788.9, 789.9, 414/792.1, 793.4, 793.8, 793.9
See application file for complete search history.

(56) References Cited

U.S. PATENT DOCUMENTS

| | | | | | |
|---|---|---|---|---|---|
| 372,410 | A | * | 11/1887 | Haffner | 271/224 |
| 2,733,064 | A | * | 1/1956 | Martin | 271/224 |
| 2,761,682 | A | * | 9/1956 | Buccicone | 271/224 |
| 2,821,391 | A | * | 1/1958 | Buccicone | 271/224 |
| 2,957,691 | A | * | 10/1960 | Williams | 271/215 |
| 3,804,402 | A | * | 4/1974 | Hottendorf | 271/139 |
| 3,986,614 | A | * | 10/1976 | Fernandez-Rana et al. | 211/51 |
| 4,340,213 | A | * | 7/1982 | Jensen | 271/219 |
| 4,380,332 | A | * | 4/1983 | Davis | 271/224 |
| 4,406,449 | A | * | 9/1983 | Buck | 271/189 |
| 4,828,246 | A | * | 5/1989 | Wegel et al. | 271/182 |
| 5,006,040 | A | * | 4/1991 | Frey | 414/789.9 |
| 5,116,036 | A | * | 5/1992 | LeRoy et al. | 271/3.01 |
| 5,201,425 | A | * | 4/1993 | Roux et al. | 271/3.03 |
| 5,244,200 | A | * | 9/1993 | Manzke | 271/198 |
| 5,374,051 | A | * | 12/1994 | Ulrich et al. | 271/222 |
| 5,727,923 | A | * | 3/1998 | Michel | 414/789.9 |
| 5,938,192 | A | * | 8/1999 | Kosasa | 271/221 |
| 5,971,385 | A | * | 10/1999 | Belec | 271/2 |
| 5,996,988 | A | * | 12/1999 | Helmstadter et al. | 271/110 |
| 6,257,571 | B1 | * | 7/2001 | Kniss et al. | 271/181 |
| 6,264,195 | B1 | * | 7/2001 | Hoberock et al. | 271/226 |
| 6,551,052 | B1 | * | 4/2003 | Bakoledis | 414/790.3 |
| 6,695,304 | B1 | * | 2/2004 | Werner | 271/146 |

FOREIGN PATENT DOCUMENTS

| | | | |
|---|---|---|---|
| EP | 354831 | A1 * | 2/1990 |
| JP | 61178332 | A * | 8/1986 |
| JP | 63185767 | A * | 8/1988 |
| JP | 06100206 | A * | 4/1994 |

* cited by examiner

*Primary Examiner*—Donald P. Walsh
*Assistant Examiner*—Matthew J. Kohner
(74) *Attorney, Agent, or Firm*—John Pietrangelo; Heslin Rothenberg Farley & Mesiti P.C.

(57) ABSTRACT

Systems, methods, and devices for preventing the misalignment of sheet material in hoppers adapted to feed sheet material to disk separators are disclosed. In one aspect, a floating backguide is provided. The floating backguide moves independently of the hopper with which the backguide is associated. The floating backguide may be pivotally mounted at a first end and free to deflect to a limited degree at a second end. In one aspect, the deflection of the second end is limited in the horizontal direction by two stationary bars and in the vertical direction by two stops. The vertical deflection of the second end of the backguide may also be limited by a resilient material, for example, a spring or an elastomer. A method for feeding sheet material to a disk separator using a floating backguide is also provided.

30 Claims, 8 Drawing Sheets

SYSTEMS, DEVICES, AND METHODS FOR FEEDING SHEET MATERIAL TO A DISK SEPARATOR

FIELD OF THE INVENTION

The present invention relates to sheet material handling systems, devices, and methods, and more particularly to a floating backguide and use of a floating backguide in systems and methods for accumulating and feeding sheet material to a separator.

BACKGROUND OF THE INVENTION

The binding and printing industries often rely on high-speed sheet material handling systems for printing, collating, binding, and otherwise handling sheet material, for example, sheets of paper. This sheet material, for example, individual sheets, newspapers, magazines, inserts and "onserts" (that is, sheet material used when collating newspapers), books, brochures, and the like, is typically, fed to and accumulated in containers or "magazines" or "hoppers" and withdrawn from the magazines or hoppers for further processing. One particular sheet material that is handled in the binding and printing industry is what is known in the art as a "signature". A signature typically comprises two or more sheets of paper that may be folded to form a spine, that is a "spine fold". Signatures may contain four or more pages of text or graphics, for example, 30 or more pages of text or graphics.

In the manufacture of books, it is common to assemble the book on a collecting conveyor by sequentially withdrawing signatures from magazines, or hoppers, containing stacks of signatures. In producing a book, typically, a plurality of serially-arranged hoppers, separating devices, and feeders are employed for gathering and collating the printed sheets of, for example, signatures. Typically, the separating devices separate and withdraw the sheet material from the hoppers and feed the sheet material to a rotating drum. The rotating drum then feeds the sheet material to a conveyor that collects and transfers the separated printed sheets for collation, binding, or other handling. The separation of the sheet material from the stacked sheet material is typically effected by a rotating disk separator. The separation of the sheet material by the disk separator is typically aided by a suction device, for example, a device known in the art as a "sucker". One typical disk-type separator is disclosed in U.S. Pat. No. 6,193,229 B1, the disclosure of which is incorporated by reference herein in its entirety. The disk separator separates and feeds the sheet material to a rotating drum that accepts and retains the sheet material and conveys it to the conveyor. The disk separator, typically with the aid of the suction device, deflects the edge of the lower-most article of sheet material in the hopper stack. When the sheets to be withdrawn from the hopper are in the form of signatures, the deflected edge is typically the spine fold portion of the signature. The rotating drum positioned below the disk separator typically includes some means of retaining the sheet material as it rotates, for example, devices known in the art as "grippers". The conveyor that receives the sheet material is typically a horizontal conveyor. This horizontal conveyor may also receive sheet material from other, typically serially-positioned, feeding drums. A common drive mechanism typically drives and synchronizes the operation of the separator, suckers, feed drum, grippers, and the conveyer.

The throughput of such systems is dependent upon on how closely together the sheet material is spaced, and on how fast the sheet material is moved. Accordingly, the throughput of such systems may be optimized by spacing the sheet material as closely together as possible and by maximizing the speed of operation of each of the components. One important factor in the operation of disk-type separators is the alignment of the sheet material with the separator disk. Since the disk separators of such devices rotate at high speed and typically "bite into" the stack of sheet material in the hopper, misalignment of the sheet material and the disk can cause misfeeds, jamming, or even damage to the equipment.

According to prior art methods, sheet material typically fed to the hopper that feeds the disk separate by means of some form of conveyor. Typically, the conveyor feeds the sheet material to the hopper such that the sheet material forms a uniform stack in the hopper. Forming a uniform stack of sheet material in the hopper helps to ensure that the sheet material is uniformly stacked so that the sheet material can be engaged and separated by the rotating disk separator. The formation of a non-uniform or misaligned stack of sheet material in the hopper can interfere with the uniform separation of the sheet material by the disk separator and, in the worst case, cause jamming of the sheet material and disruption of the production facility. Thus, the uniform alignment of the stacked sheet material is highly desired by the operator.

In prior art sheet material handling systems, the uniform alignment of the sheet material is aided by a device known in the art as a "backguide". A backguide is a device located beneath the point at which the conveyor introduces sheet material to the hopper and acts as a guide or baffle which promotes the proper alignment of the sheet material as the sheet material is stacked into the hopper. Among other things, the backguide minimizes the misalignment of the stack of sheet material by providing a surface upon which the sheet material can bear as the sheet material is inserted into the hopper.

In the conventional art, the hopper typically comprises a platen or "hopper tray" upon which the sheet material is stacked. The hopper tray is typically an adjustable tray that permits the operator to vary the tray's position and orientation depending upon the nature of the sheet material being handled by the hopper. For example, stiffer sheet materials typically require a different tray position and orientation relative to the feeding mechanism than do less stiff, or flimsier, sheet materials. Proper location of the tray promotes optimum feeding of the sheet material to the disk separator. The lateral position of the hopper tray typically can be varied by moving, or translating, the tray either toward the disk separator, that is, in the "fore" direction, or away from the disk separator, that is, in the "aft" direction. The hopper tray may also be tilted, or rotated, in the fore and aft directions depending upon the stiffness of the sheet material being handled.

This translation or rotation of the hopper tray typically influences the operation of the backguide. Since the backguide typically and preferably works in unison with the hopper tray, conventional backguides are typically rigidly attached to the hopper tray so that the backguide translates or rotates with the translation or rotation of the hopper tray. However, rigidly mounting the backguide to the hopper tray whereby the backguide moves with the hopper tray can interfere with the function of the backguide and cause misalignment of the sheet material. One aspect of the present invention overcomes this disadvantage of the prior art.

In one prior art configuration, the backguide comprises a two-piece backguide, one piece fixed to the hopper tray and one piece fixed to the conveyor housing feeding the hopper tray. However, translation and rotation of one piece of the two-piece backguide with the hopper tray relative to the fixed backguide can produce misalignment between the two pieces and can cause jamming of the sheet material, which of course is to be avoided. One aspect of the present invention overcomes this disadvantage of the prior art backguides.

SUMMARY OF THE INVENTION

The present invention provides systems, devices, and methods that address many of the limitations of prior art systems and methods. One aspect of the invention is a system for feeding sheet material to a disk separator, the system including a hopper tray adapted and positioned for receiving the sheet material and feeding the sheet material to the disk separator; means for feeding the sheet material to the hopper tray in a first direction; and means for preventing the sheet material from dislodging from the hopper tray in a second direction, opposite the first direction; wherein the means for preventing the sheet material from dislodging is mounted independent of the hopper tray. The hopper tray may comprise a movable hopper tray and the means for preventing the sheet material from dislodging may be free to move when the hopper tray is moved. In one aspect of the invention, the means for preventing the sheet material from dislodging may comprise a floating backguide. In one aspect of the invention, the floating backguide may comprise a pivotally-mounted backguide, for example, the pivotally-mounted backguide may comprise a pivotally-mounted first end and a deflectable second end. In one aspect of the invention, the pivotally-mounted backguide may further comprise at least one substantially vertical baffle against which the sheet material bears when the sheet material is fed to the hopper tray. In one aspect of the invention, the pivotally-mounted backguide may further comprise at least one substantially horizontal plate which at least a portion of the sheet material contacts when the sheet material is fed to the hopper tray.

Another aspect of the invention is a method for feeding sheet material to a disk separator, the method including: providing a moveable hopper tray for receiving the sheet material, the hopper tray adapted and positioned for feeding a disk separator; feeding the sheet material to the hopper tray in a first direction wherein the sheet material accumulates on the hopper tray; providing a moveable backguide to prevent the sheet material from dislodging from the hopper tray in a second direction, opposite the first direction, the moveable backguide contacting the hopper tray; and adjusting the position of the hopper tray to optimizing the feeding of the sheet material to the disk separator wherein the moveable backguide freely moves with the hopper tray. In one aspect of the invention, adjusting the position of the hopper tray may comprise one of pivotal adjustment and lateral adjustment. In one aspect of the invention, feeding sheet material may comprise overlapping single-stream feeding. In another aspect of the invention, providing a moveable backguide may comprise providing a backguide having a pivotally-mounted first end and a deflectable second end. In one aspect of the invention, the method may further comprise limiting the deflection of the deflectable second end of the backguide.

Another aspect of the invention is a backguide for a hopper, the backguide adapted and positioned for feeding sheet material to a disk separator, the backguide including: an elongated structure having a pivotally mounted first end and a second end; at least one substantially vertical baffle mounted to the elongated structure for retaining sheet material in the hopper; and at least one substantially horizontal plate mounted to the elongated structure for supporting at least a portion of the sheet material fed to the hopper. In one aspect of the invention, the backguide may further comprise a guide projection mounted at the second end of the elongated structure. In another aspect of the invention, the guide projection may comprise a substantially horizontal projection. In another aspect of the invention, the backguide may further comprise at least one setscrew for limiting the deflection of the backguide.

A further aspect of the invention is a mounting arrangement for a backguide for a sheet material hopper, the backguide having a first end and a second end and the sheet material hopper is adapted and positioned for feeding sheet material to a disk feeder, the backguide mounting arrangement including: means for pivotally mounting the first end of the backguide; and means for limiting the deflection of the second end of the backguide. In one aspect of the invention, the backguide may comprise a guide projection mounted at the second end, and wherein the means for limiting the deflection of the second end limits the deflection of the guide projection. In one aspect of the invention, the means for limiting the deflection of the second end may comprise means for limiting at least one of lateral deflection and vertical deflection of the second end. In another aspect of the invention, the means for limiting deflection of the second end may comprise at least one rigidly-mounted vertical bar which limits the lateral deflection of the guide projection. In one aspect of the invention, the means for limiting the lateral deflection may comprise two rigidly-mounted vertical bars that straddle the guide projection. In another aspect of the invention, the two rigidly-mounted vertical bars may comprise adjustably mounted vertical bars. In one aspect of the invention, the means for limiting deflection of the second end may comprise means for limiting the vertical deflection of the guide projection, for instance, by resilient means, for example, using at least one coil spring.

Thus, aspects of the present invention provide improved operation of sheet material feeding to disk separators that minimize sheet material jamming while accommodating variations in the position and orientation of hopper trays.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF FIGURES

Figure 1:
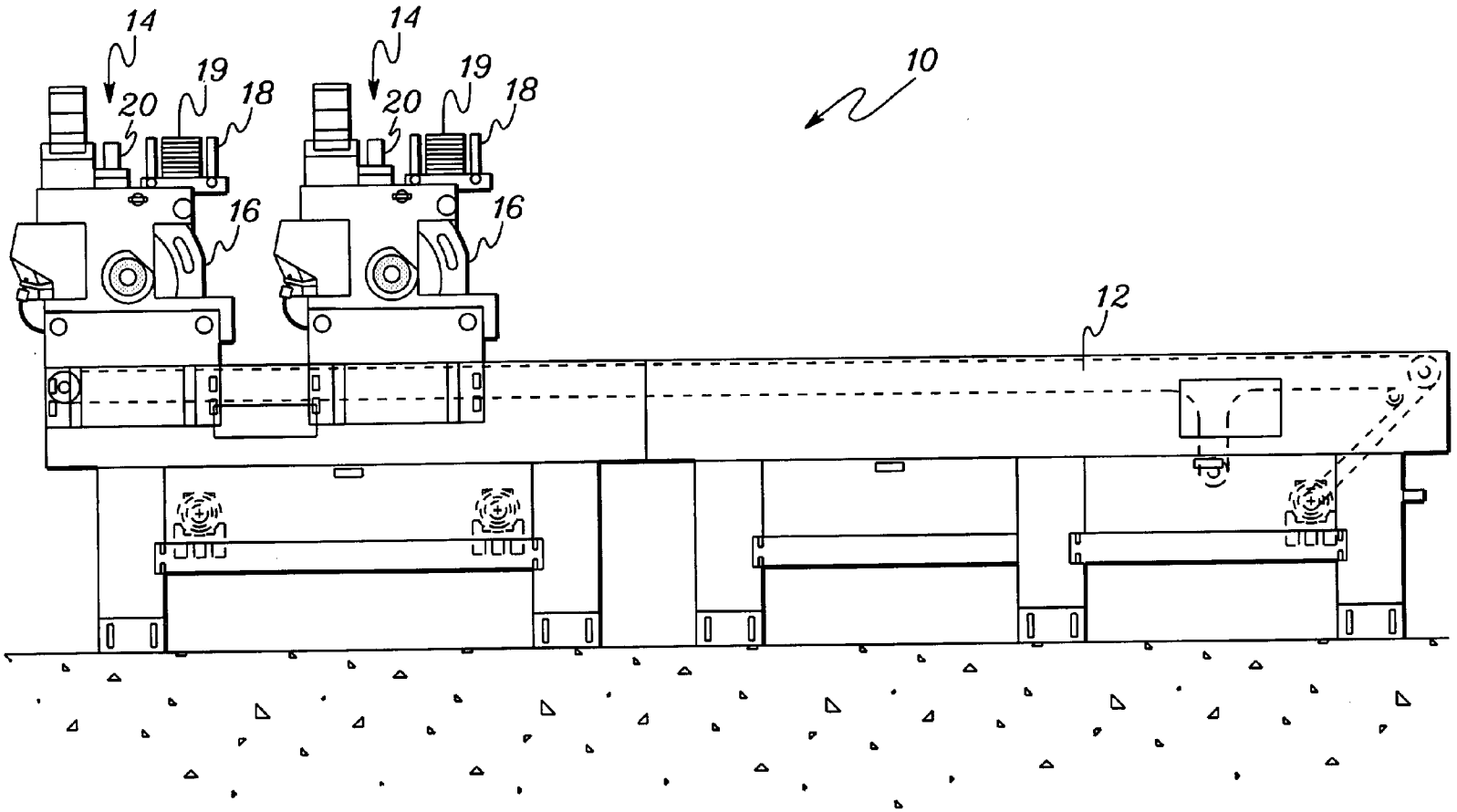
FIG. 1 is a side elevation view of a feeding and conveying system for sheet material for which the present invention is an improvement.

The details and scope of aspects of the present invention can best be understood upon review of the attached figures and their following descriptions. FIG. 1 illustrates a feeding and conveying system, generally designated with the reference numeral 10, for feeding and conveying sheet material that can employ one or more aspects of the present invention. The sheet material that can be fed and conveyed by system 10 according to aspects of the present invention includes, but is not limited to, individual sheets, signatures, newspapers, magazines, books, booklets, brochures, inserts, or onserts, among other types of sheet material.

Feeding and conveyer system 10 typically includes a conveyer 12, and at least one, typically more than one, sheet material feeder 14. Each sheet material feeder 14 includes a rotatable feed drum 16, a magazine or hopper 18 of stacked sheet material 19, and a separator disk 22 (see FIG. 2) driven by a servomotor 20. Sheet material feeder 14 separates sheet material 19 stacked in magazine or hopper 18 and feeds the sheet material 19 via drum 16 to conveyor 12. Conveyor 12 may be a collating conveyor, that is, a collator, or a gathering conveyor, that is, a gatherer, among other types of conveyors. For example, in one aspect of the invention, conveyor 12 receives onserts from feeder 14 which are placed on top of articles of sheet material, for example, other onserts, that are already on conveyor 12.

The conveyer 12 is positioned with respect to the feed drums 16 for receiving sheet material from feed drum 16. Feed drum 16 rotates and delivers sheet material 19, typically one at a time, to conveyer 12. Conveyer 12, in accordance with one aspect of the invention, functions to gather, collate, or otherwise handle sheet material 19. For example, feeding and conveying system 10 shown in FIG. 1 may include multiple feeders 14 and may be configured to enable conveyer 12 to gather and collate sheet material for a binding machine, though the system shown in FIG. 1 may be used to convey sheet material to other types of machines.

Figure 2:
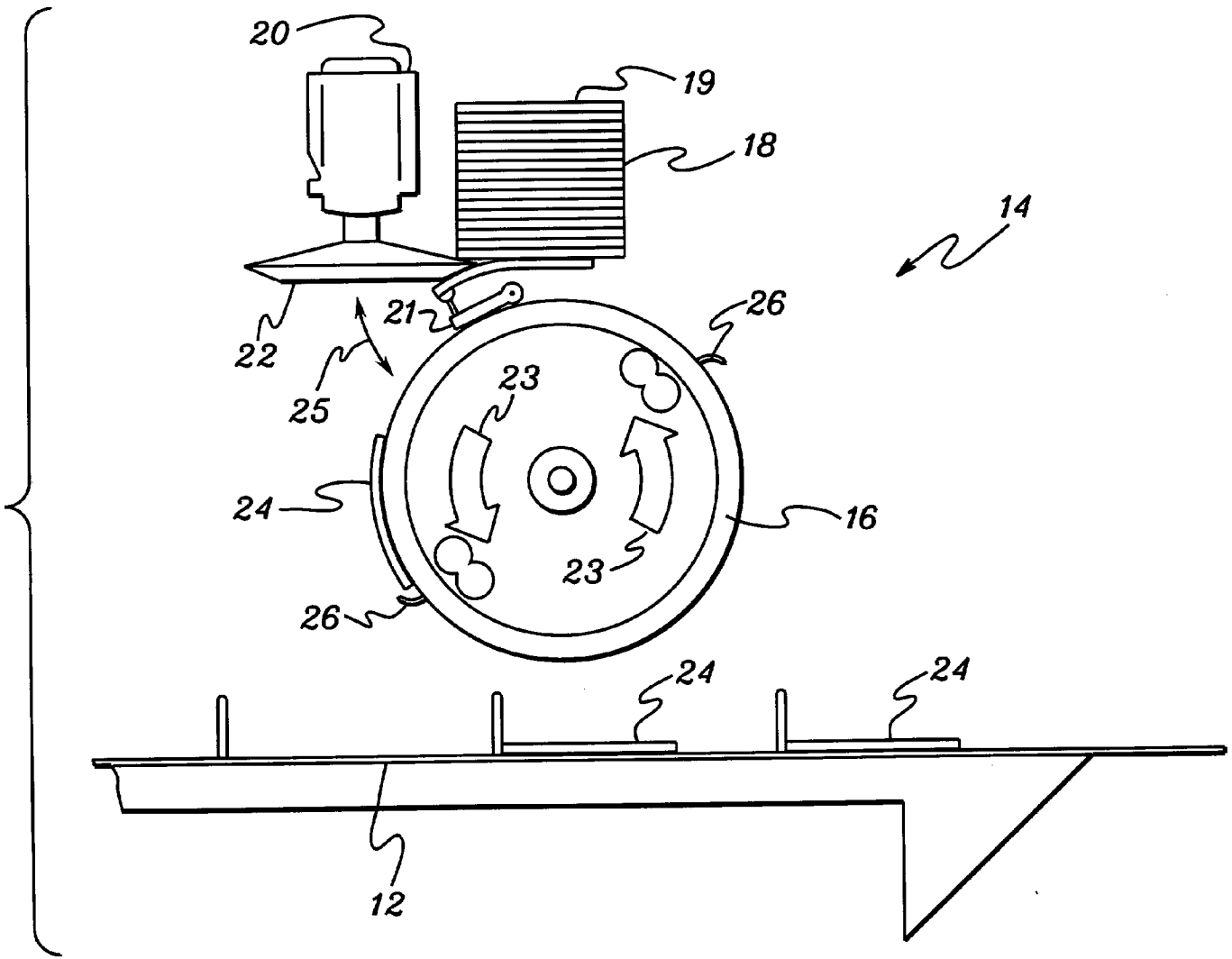
FIG. 2 is a detailed side elevation view of a disk-type feeder for sheet material used in the feeding and conveying system shown in FIG. 1.

FIG. 2 illustrates a side elevation view of some of the components that comprise sheet material feeder 14 shown in FIG. 1 which feeds conveyor 12 shown in FIG. 1. Conveyor 12 in FIG. 2 is a collating-type of conveyor, though other types of conveyors may be used. As noted above, and as shown more clearly in FIG. 2, feeder 14 includes a rotatable feed drum 16, a magazine 18 of stacked sheet material 19, and a separator disk 22 driven by a servomotor 20. As shown in FIG. 2, feeder 14 typically also includes means for deflecting the edge of an article of sheet material 19 from the magazine 18. One means for deflecting the edge of an article of sheet material 19 from the magazine 18 may be means for selectively applying a source of vacuum to the lower-most article of sheet material 19 in magazine 18. In the aspect shown in FIG. 2, a device 21 known in the art as a "sucker" is used for selectively applying a source of vacuum. Sucker or suction device 21 is operatively connected to a source of vacuum (not shown) and is adapted to selectively apply the vacuum to the sheet material 19, for example, as a synchronized function of the relative rotation of drum 16. Suction device 21 is also typically pivotally mounted for rotation as indicated by double arrow 25, that is, suction device 21 may be raised and lowered to engage and deflect sheet material 19. Suction device 21 typically applies a vacuum to the surface of an article of sheet material 19 that varies from about 18 inches of Hg (that is, inches of mercury) to about 25 inches of Hg.

Separator disk 22 is mechanically coupled to servomotor 20. Servomotor 20 typically rotates disk 22 at maximum speeds of between about 900 rpm and about 1200 rpm. Separator disk 22 is positioned adjacent to magazine 18 whereby at least a portion of the surface of disk 22 engages and separates at least one article of sheet material 19, typically only one article 19 at a time. After an article of sheet material 19 is engaged and deflected by suction device 21, disk 22 engages and deflects article of sheet material 19 whereby article 19 can be engaged and retained by drum 16. Typically, only an edge of an article of sheet material 19 is deflected by suction device 21 and disk 22 and each article 19 is drawn out of the magazine by the rotation of drum 16. As disclosed in copending U.S. application Ser. No. 09/882,002 of Hall and Prim filed on Jun. 15, 2001, now U.S. Pat. No. 6,623,000 (the disclosure of which is incorporated by reference herein), the rotation of servomotor 20 and thus separator disk 22 may be controlled whereby disk 22 is reciprocatingly rotated, that is, disk 22 is rotated in a first direction and then in a second direction, opposite the first direction, and preferably repeatedly. This reciprocating rotation helps to avoid misalignment of the articles 19 in magazine 18.

After sheet material 19 is engaged by and deflected by suction device 21 and separator disk 22 engages and further deflects and separates an article of sheet material 19, the article of sheet material 19 is positioned to be captured by feed drum 16. The separated article of sheet material on drum 19 is identified by reference number 24 in FIG. 2. In the view shown in FIG. 2, feed drum 16 rotates in a counter-clockwise direction as indicated by arrows 23. Typically, feed drum 16 includes some means for grasping and capturing article of sheet material 24 from magazine 18 and transferring it to conveyor 12. One means of grasping, capturing, and transferring sheet material 24 is hinged linkages 26 that are selectively opened and closed to grasp and release an article of sheet material 24. Linkages 26 are known in the art as "grippers". Drum 16 may have one or more grippers, and typically, two or more grippers evenly spaced about the periphery of drum 16. For example, in one aspect of the present invention three grippers 26 are used. Grippers 26 retain the separated sheet material 24 and transfer it with the rotation of drum 16 to conveyor 12. When the sheet material 24 is in position over conveyor 12, gripper 26 opens allowing sheet material 24 to fall, typically, simply under the force of gravity, upon conveyor 12. The position of grippers 26, that is, either opened or closed, is typically controlled and synchronized with the relative rotation of drum 16 and the operation of suckers 21 to ensure the uninterrupted movement of articles of sheet material 24 from magazine 28 to drum 16 to conveyor 12.

Figure 3:
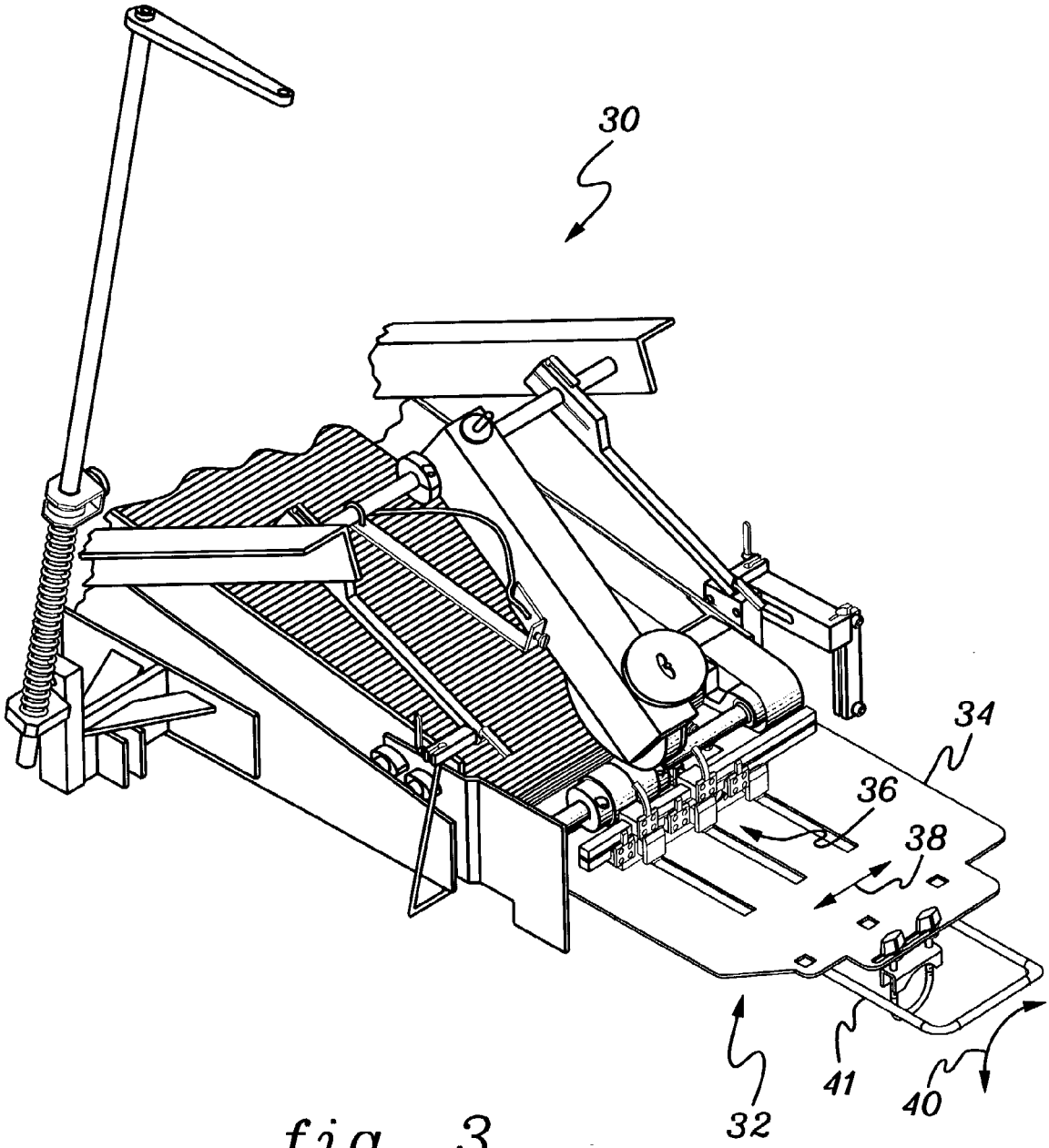
fig. 3 PRIOR ART
FIG. 3 is a perspective view of a prior art hopper and feeding mechanism having a fixed backguide over which the present invention is an improvement.

FIG. 3 illustrates typical prior art sheet material conveyor assembly 30 for feeding sheet material to magazine or hopper 18 shown in FIG. 2. Hopper 18 typically comprises an adjustable hopper tray assembly 32 upon which articles 19 are stacked by conveyor assembly 30. As shown in FIG. 3, a typical prior art hopper tray assembly 32 includes a tray 34 and a backguide assembly 36 mounted to hopper tray 34. Backguide assembly 36 functions to prevent misalignment of articles 19 as articles 19 are fed to hopper tray assembly 32 by conveyor assembly 30. As is typical in the art, hopper tray assembly 32 may be adjustably mounted whereby hopper tray may be moved or translated as indicated by double arrow 38 and rotated or tilted as indicated by double arrow 40 to accommodate the stiffness of the article 19 being handled. The orientation of tray assembly 32 may be manually varied by means of handle 41. According to the prior art hopper assembly 32 shown in FIG. 3, since backguide assembly 36 is mounted to hopper tray 34, backguide assembly 36 must move with any movement of hopper assembly 32. This movement of backguide assembly 36 with hopper assembly 32 can interfere with the guiding function of backguide 36 whereby misalignment of and even jamming of articles 19 can result. One aspect of the present invention shown in FIG. 4 overcomes this limitation of the prior art.

Figure 4:
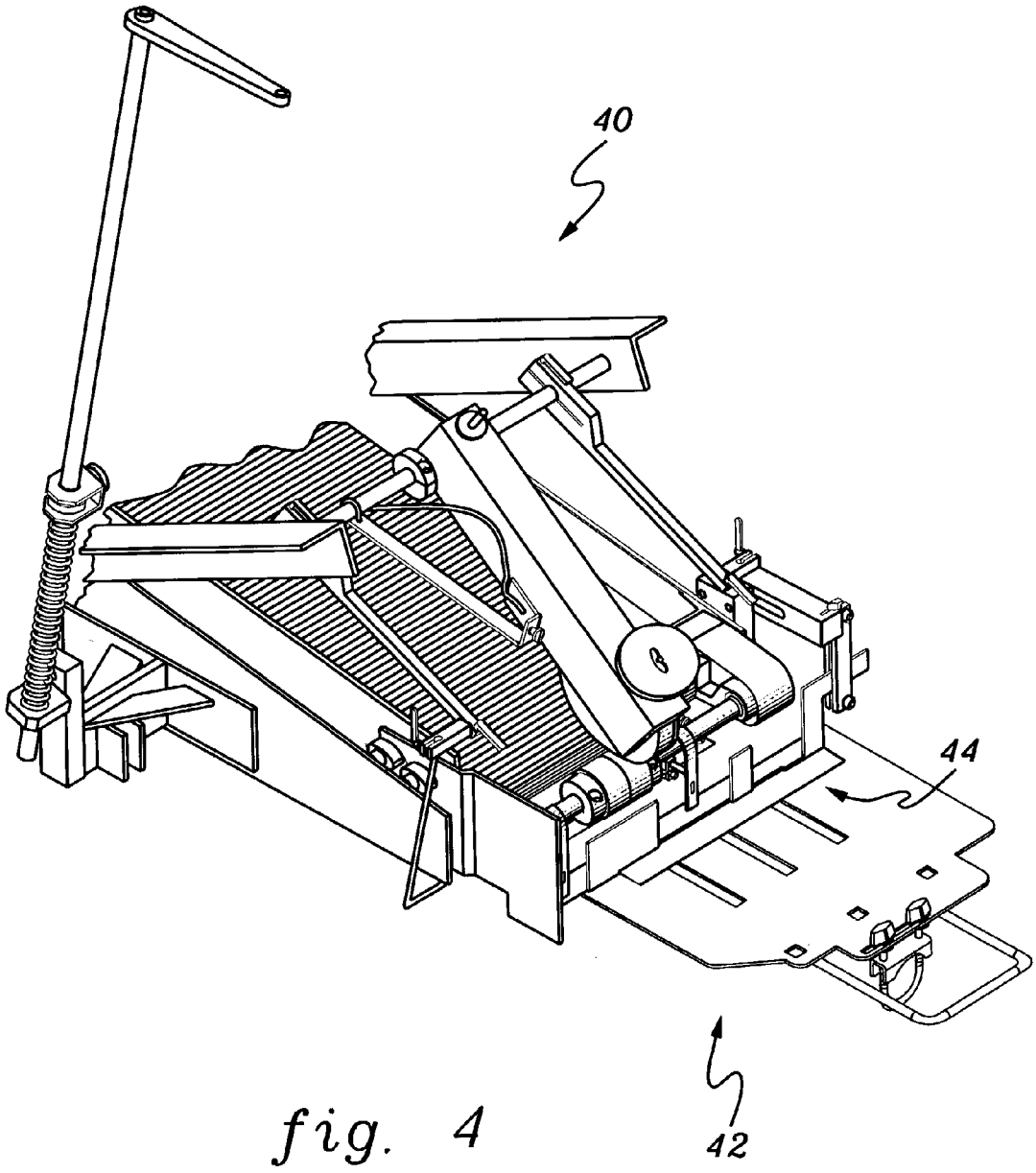
FIG. 4 is a perspective view similar to FIG. 3 of a hopper and feeding mechanism having a floating backguide according to one aspect of the present invention.

FIG. 4 illustrates material conveyor 40 for feeding sheet material to magazine or hopper 18 shown in FIG. 2 according to one aspect of the present invention. Conveyor 40 is similar to conveyor assembly 30 shown in FIG. 3 whereby conveyor 40 feeds sheet material 19 to a hopper tray assembly 42. However, according to one aspect of the present invention, conveyor 40 includes a non-rigid or "floating" backguide assembly 44. Unlike back guide assembly 36 shown in FIG. 3, backguide assembly 44 is not mounted to hopper tray assembly 42. According to one aspect of the present invention, backguide assembly 44 is permitted to move, that is, translate or rotate, independently of the movement of hopper tray assembly 42. According to this aspect of the present invention, the freedom of backguide assembly 44 to move independently of hopper tray assembly 42 ensures the backguide assembly 44 can properly perform its function and thus minimizes the potential for misalignment of the articles 19 on hopper tray assembly 42 whereby disk separator 22 can effectively feed articles 19 to feed drum 16.

Figure 5:
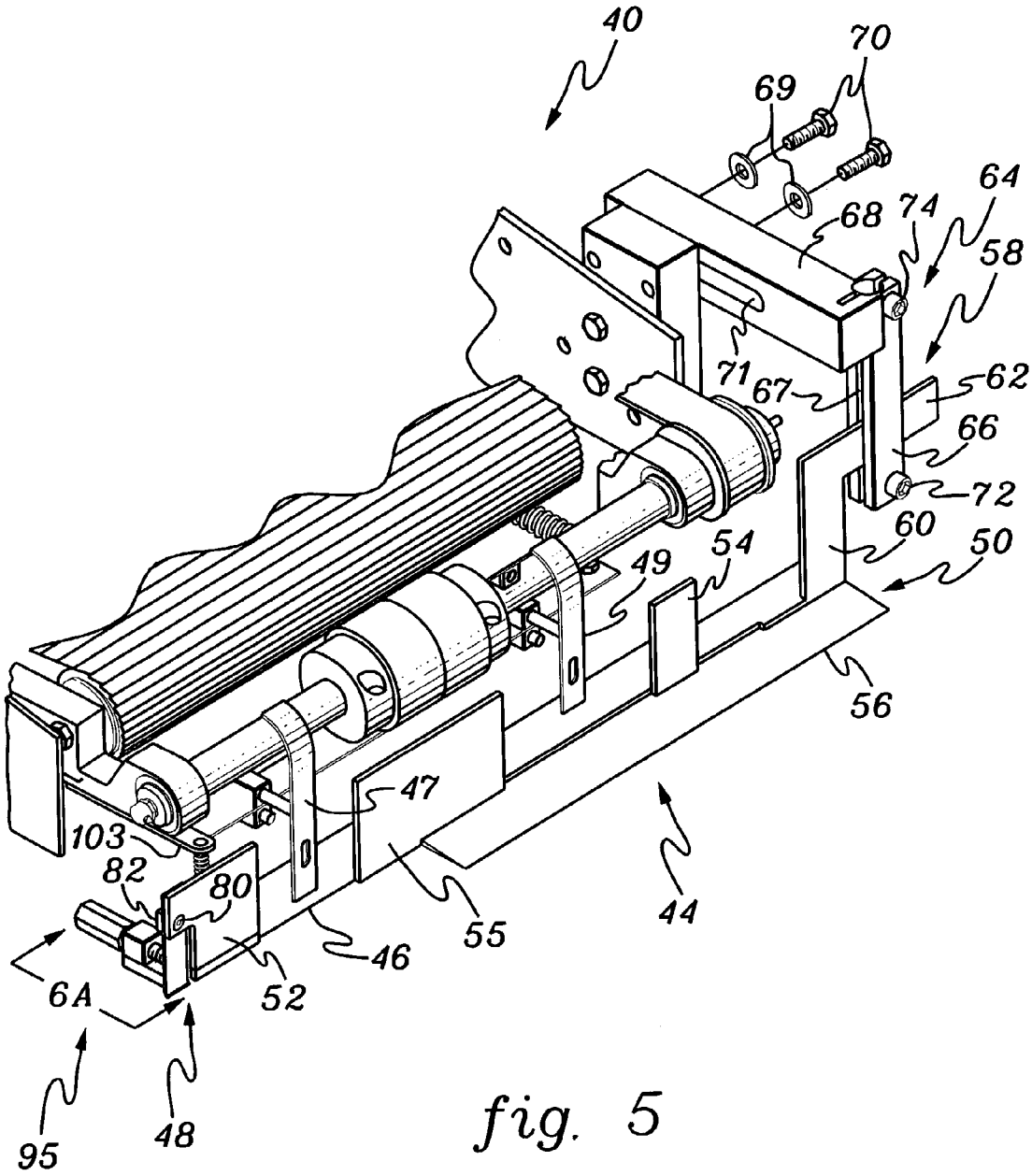
FIG. 5 is a perspective detailed view of the feeding mechanism and floating backguide shown in FIG. 4 according to one aspect of the present invention.
Figure 6:
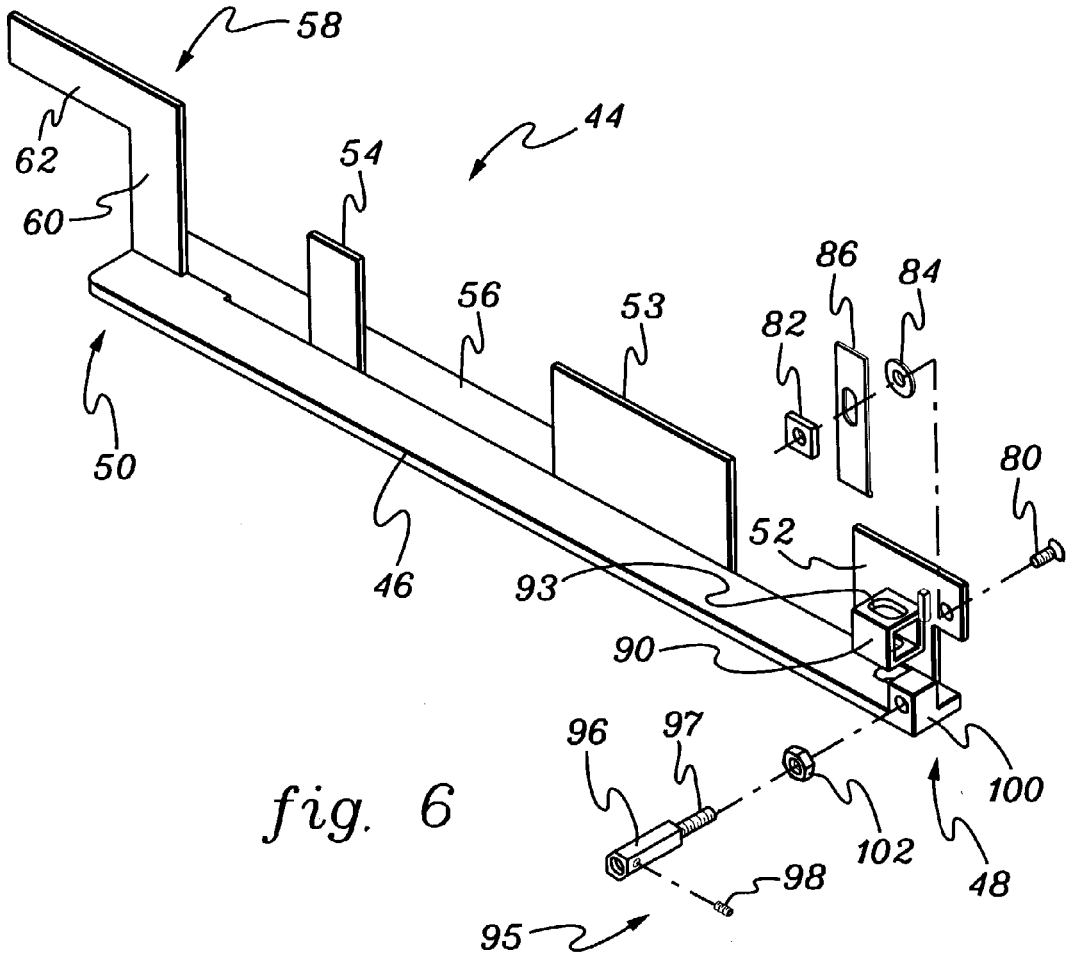
FIG. 6 is an exploded perspective view of a floating backguide according to one aspect of the present invention.

A detailed view of backguide assembly 44 mounted on conveyor assembly 40 is shown in FIG. 5. An exploded, rear isometric view of backguide assembly 44 is shown in FIG. 6. According to one aspect of the invention, backguide assembly 44 includes an elongated structure 46 having a first end 48 adapted for pivotal mounting and a second end 50 free to translate in at least a vertical direction. Structure 46 may be an elongated plate, bar, tube, or rod among other structural members and forms the "backbone" upon which other elements are mounted to backguide assembly 44. Backguide assembly 44 also may include at least one substantially vertical baffle plate 52, 53, and 54 mounted to elongated structure 46 to assist in maintaining the proper alignment of the articles 19 (not shown). Conveyor assembly 40 may also include curved "fingers" 47, 49 mounted to conveyor 40 which may also assist in guiding articles 19 from conveyor assembly 40 to hopper 18 (See FIG. 2 for hopper 18.). Backguide assembly 44 may also include at least one substantially horizontal plate 56 mounted to structure 46 for supporting at least a portion of the sheet material 19 fed to the hopper tray assembly 42 (see FIG. 4). According to one aspect of the invention, backguide assembly 44 may also include a guide projection 58 mounted at the second end 50 of elongated structure 46. Guide projection 58 may comprise a substantially vertical plate 60 mounted to the second end 50 of structure 46. The substantially vertical plate 60 may have a substantially horizontal projection 62.

Backguide assembly 44 may also include a guide means 64 for limiting the deflection of second end 50. Guide means 64 may include a set of spaced bars 66, 67 that straddle horizontal projection 62. Bars 66, 67 may be adjustably mounted to conveyor assembly 40, for example, by means of mounting bar 68. Mounting bar 68 may be mounted to conveyor assembly 40 by means of one or more threaded fasteners 70 and washers 69. The adjustable mounting of bars 66, 67 to conveyor assembly may be effected by means of longitudinal slot 71 in mounting bar 68. Bars 66, 67 limit the lateral movement of projection 62 and thus limit the lateral movement of backguide assembly 44. In one aspect of the invention, guide means 64 also limits the vertical deflection of backguide assembly 44, for example, by means of fasteners 72, 74 or some other type of stop, pin, dowel, and the like, mounted in bars 66, 67 as shown in FIG. 5. Fasteners 72, 74 may be conventional threaded fasteners, for example, socket head cap screws.

Figure 7:
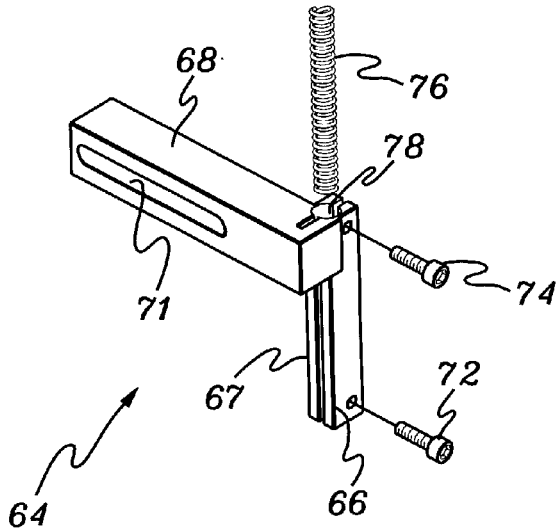
FIG. 7 is an exploded perspective view of one guide assembly that can be used with the floating backguide of FIG. 6 according to one aspect of the present invention.

A detailed exploded view of guide means 64 for limiting the deflection is shown in FIG. 7. In one aspect of the invention, bars 66, 67 and mounting bar 68 comprise an integral one-piece part, for example, a part machined from one piece of metal. In another aspect of the invention bars 66, 67 are mounted to mounting bar 68 by conventional means, for example, by welding or by means of one or more mechanical fasteners. As shown in FIG. 7, guide means 64 may also include a resilient mounting to minimize any shock loading and damage to either projection 62 (see FIGS. 5 and 6) or guide means 64. In one aspect of the invention, the resilient mounting may comprise a spring 76 or elastomeric element mounted between bars 66, 67. For example, in one aspect of the invention, spring 76 may be mounted in blind hole 78. Spring 76 may be retained in blind hole 78 by one of the fasteners 74. Though only a single spring 76 is shown in FIG. 7, in one aspect of the invention, at least two springs may be mounted at either end of bars 66, 67 to minimize shock and damage when backguide assembly 44 is deflected in either direction.

Figure 6A:
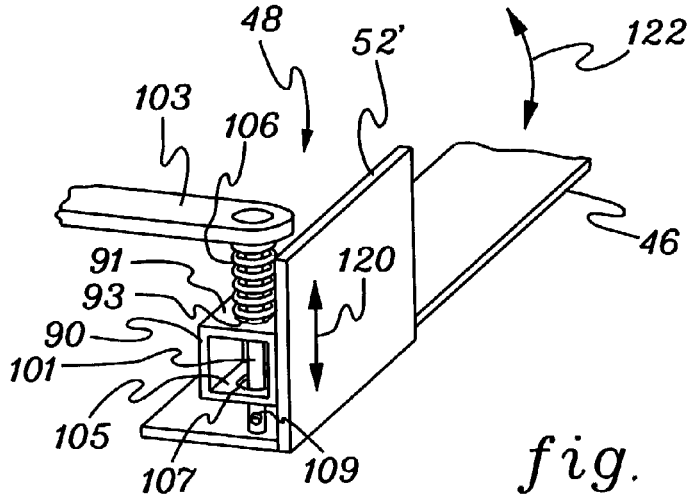
FIG. 6A is a detailed view of the mounting arrangement for the backguide as shown in FIG. 6.

As shown in FIG. 5, in one aspect of the invention, structure 46 of backguide assembly 44 in is mounted at first end 48 to conveyor assembly 40. FIG. 6A illustrates a mounting of backguide assembly 44 according to one aspect of the present invention. FIG. 6A is a detailed view of end 48 of elongated structure 46 as viewed along lines 6A—6A shown in FIG. 5. In the aspect of the invention shown in FIG. 6A, backguide assembly 44 does not include a rear restrictor assembly 95 (discussed below). According to this aspect of the invention, a baffle plate 52' of backguide assembly 44 includes a box structure 90, which may be an open box structure, or simply two horizontal plates mounted on baffle plate 52'. Box structure 90 includes a top surface 91 having a through hole 93 and a bottom surface 105 having a through hole 107. According to this aspect of the invention, backguide 44 is mounted to conveyor assembly 40 by means of rod 101 which passes through holes 93 and 107. Rod 101 may be mounted to conveyor assembly 40, for example, to a mounting plate 103 which is mounted to conveyor assembly 40 (see FIG. 5), for example, by means of one or more threaded fasteners (not shown). According to one aspect of the invention, a resilient element 106, such as a coil spring or cylinder made of elastomeric material, may be mounted to rod 101, for example, between top plate 91 and mounting plate 103. Rod 101 may be retained by any conventional means, for example, by means of pin 109.

According to the aspect of the invention shown in FIG. 5A, end 48 may vertically deflect, for example, as indicated by double arrow 120, or may angularly deflect, as indicted by double arrow 122, for example, as hopper tray assembly 42 (see FIG. 4) deflects. The vertical deflection is limited by resilient element 106 and pin 109. In one aspect of the invention, though hole 93, through hole 107, or both comprise elongated through holes (see FIG. 6) which allow rod 101 to deflect when backguide assembly 44 angularly deflects.

As shown in FIGS. 5 and 6, backguide assembly 44 may also include a rear restrictor assembly 95 which may be used to support relatively flimsy products while feeding. In one aspect of the invention, rear restrictor assembly 95 comprises a hexagonal shaft 96 mounted to a threaded shaft 97. The hexagonal shaft 96 may be retained on threaded shaft 97 by means of one or more set screws 98, though other types of constructions may be used. Threaded shaft 97 engages end 48 of elongated structure 46 and bears against restrictor plate 86. Restrictor plate 86 may be mounted to plate 52 by means of screw 80, washer 84, and nut 86. In one aspect of the invention, threaded shaft 97 engages and passes through a threaded block 100 mounted on end 48, though other types of structures may be used for block 100. According to this aspect of the invention, threaded shaft 97 bears against restrictor plate 86, for example, bears against the lower end of plate 86, whereby plate 86 can be deflected to a desired position. The position of plate 86 will depend upon the stiffness of the sheet material being fed. One or more nuts 102 on threaded shaft 97 may also be used with rear restrictor assembly 95 to "lock" the position of threaded rod 97 and the deflection of plate 86 where desired. In one aspect of the invention, rear restrictor assembly 95 may be omitted without interfering with the function and operation of backguide assembly 44.

According to one aspect of the present invention, elongated structure 46 may comprise a flat plate having a thickness of between about 0.01 inches and about 0.25 inches, for example, a thickness of between about 0.03 inches and about 0.19 inches; a width of between about 0.50 inches and about 5 inches, for example, a width of between about 0.75 inches and about 2.0 inches; and a length of between about 6 inches and about 24 inches, for example, a length of between about 8 inches and about 15 inches. Baffle plates 52, 53, and 54 may comprise plates, for example, flat plates, having a thickness of between about 0.03 inches and about 0.25 inches, for example, a thickness of between about 0.06 inches and about 0.12 inches; a width of between about 0.25 inches and about 5 inches, for example, a width of between about 0.75 inches and about 2.0 inches; and a length of between about 0.5 inches and about 12 inches, for example, a length of between about 1 inch and about 5 inches. Horizontal plate 56 may comprise a flat plate having a thickness of between about 0.01 inches and about 0.25 inches, for example, a thickness of between about 0.03 inches and about 0.19 inches; a width of between about 0.5 inches and about 3 inches, for example, a width of between about 0.75 inches and about 1.5 inches; and a length of between about 4 inches and about 24 inches, for example, a length of between about 8 inches and about 15 inches. As shown in FIG. 5, plate 56 may be tapered from a first thickness to a second, smaller thickness, for example, plate 56 may taper from a first thickness of about 0.19 inches to a second thickness of about 0.03 inches. Elongated structure 46; baffle plates 52, 53, and 54; and horizontal plate 56 may comprise one or more of the following materials: plastic, iron, steel, stainless steel, aluminum, and any other suitable material. Elongated structure 46; baffle plates 52, 53, and 54; and horizontal plate 56 may be assembled by conventional means for example, welding, adhesives, and mechanical fasteners, among other methods of fabrication. Though backguide assembly 44 is illustrated as an fabricated assembly, for example, welded from individual parts, all or part of backguide assembly may also be formed as one or more integral parts, for example, casting (for instance sand or investment casting), forging, molding, or lithography, among other methods.

Figure 8:
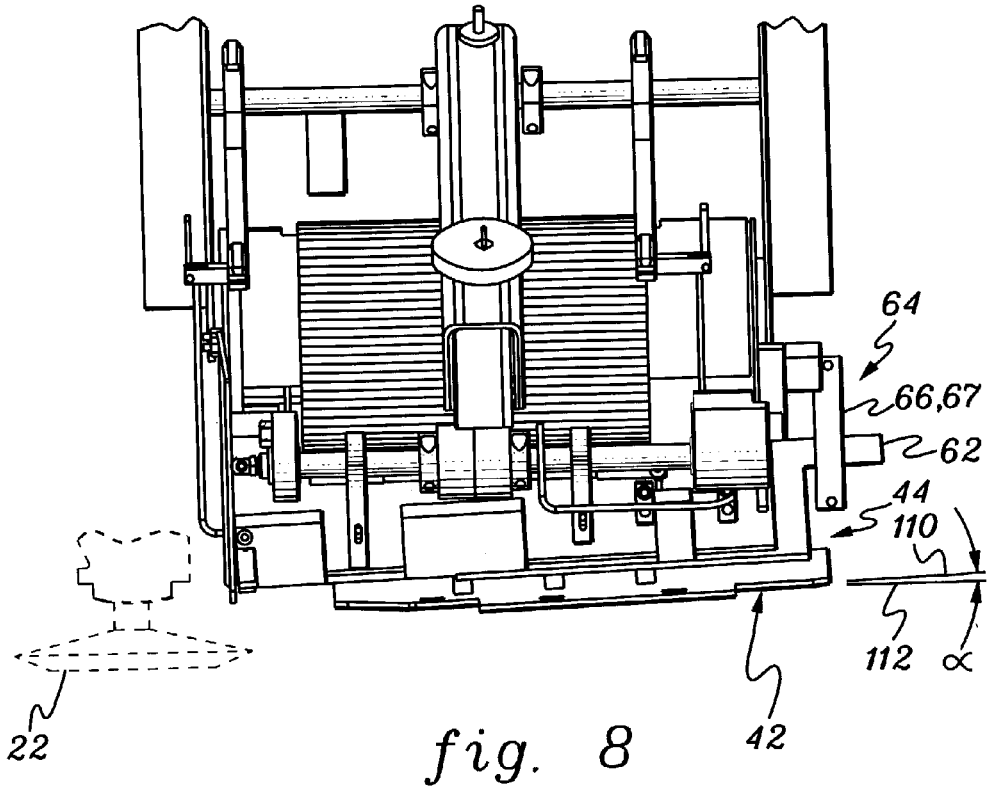
FIGS. 8 and 9 are front elevation views of the present invention illustrating the relative movement of the backguide and hopper tray according to aspects of the present invention.
Figure 9:
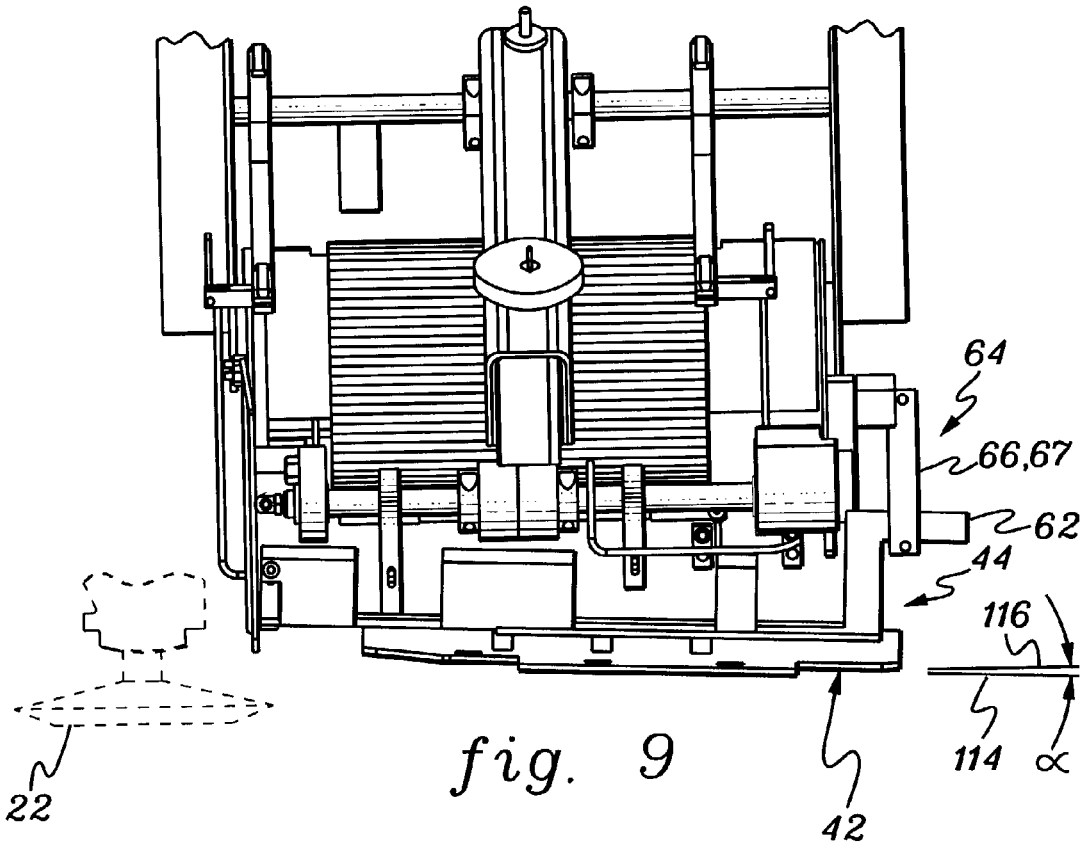

FIGS. 8 and 9 illustrate the relative movement of hopper tray assembly 42 and backguide 44 that is achievable according to one aspect of the present invention. FIGS. 8 and 9 illustrate front elevation views of the tray assembly 42 and backguide assembly 44 illustrated in FIG. 4 mounted on conveyor assembly 40 according to aspects of the present invention. Many of the structures and elements identified in FIGS. 4, 5, 6, and 7, are also identified in FIGS. 8 and 9. Separator disk 22 is shown in phantom in FIGS. 8 and 9 for reference. In FIG. 8, hopper tray assembly 42 is canted in a counterclockwise direction wherein the surface of tray assembly 42, as indicated by line 110 in FIG. 8, makes an angle $\alpha$ with the horizontal, as indicated by line 112. The angle $\alpha$ may typically range from about 0 degrees to about 6 degrees, for instance, between about 0 degrees and about 3 degrees, in the counterclockwise direction. For example, in FIG. 8, tray assembly 42 is rotated about 2 degrees in the counterclockwise direction. When feeding less stiff articles 19 (not shown), for example, newsprint stock or light single sheets, from tray assembly 42 to disk separator 22, tray assembly 42 is typically rotated slightly in the counterclockwise direction as indicated by a to more effectively remove articles 19 from tray assembly 42.

As also shown in FIG. 8, the deflection of backguide assembly 44 is guided by guide means 64, for example, guide projection 62 is guided by bars 66, 67. Though not shown in FIG. 8, in one aspect of the invention, guide projection 62 may impact spring 76 (See FIG. 6.) to absorb the impact of and limit the deflection of backguide assembly 44.

Similarly, in FIG. 9, hopper tray assembly 42 is canted in a clockwise direction wherein the surface of tray assembly 42, as indicated by line 114 in FIG. 9, makes an angle $\alpha$ with the horizontal, as indicated by line 116. Again, the angle $\alpha$ may typically range from about 0 degrees to about 6 degrees, for instance, between about 0 degrees and about 3 degrees, in the clockwise direction. For example, in FIG. 9, tray assembly 42 is rotated about 2 degrees in the clockwise direction. When feeding stiffer articles 19 (not shown), for example, thick offset magazine signatures, from tray assembly 42 to disk separator 22, tray assembly 42 is typically rotated slightly in the clockwise direction as indicated by $\alpha$ to more effectively remove articles 19 from tray assembly 42.

As was also illustrated in FIG. 8, FIG. 9 also illustrates that the deflection of backguide assembly 44 may be guided by guide means 64; for example, guide projection 62 is guided by bars 66, 67. As shown in FIG. 9, the guide projection 62 may contact fastener 72 (See FIG. 6.) to limit the deflection of backguide assembly 44.

As shown in FIGS. 8 and 9, according to one aspect of the present invention, backguide assembly 44 deflects with tray assembly 42 wherein few or no dislocations or separations occur between backguide assembly 44 and tray assembly 42. Again, in this aspect of the invention, unlike prior art backguides, the deflection of tray assembly 42 does not interfere with the proper orientation and operation of backguide 44.

Aspects of the present invention provide improved systems, devices, and methods for accumulating and feeding sheet material, such as book signatures, during the collating and binding of, for example, books and newspapers. Aspects of the present invention, minimize or prevent misfeeding of sheet material to disk-type separators while allowing for adjustment of hopper trays to accommodate sheet material of varying size and stiffness. As will be appreciated by those skilled in the art, features, characteristics, and/or advantages of the systems, devices, and methods for accumulating and feeding sheet material described herein, may be applied and/or extended to any embodiment (e.g., and/or portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

We claim:

1. A backguide for a hopper, the backguide adapted and positioned for feeding sheet material to a disk separator, the backguide comprising:

an elongated structure having a pivotally mounted first end and a second end;

at least one substantially vertical baffle mounted to the elongated structure for retaining sheet material in the hopper;

at least one substantially horizontal plate mounted to the elongated structure for supporting at least a portion of the sheet material fed to the hopper; and a guide means adapted to limit the deflection of the second end of the elongated structure, the guide means comprising a pair of spaced bars.

2. The backguide as recited in claim 1, further comprising a guide projection mounted at the second end of the elongated structure.

3. The backguide as recited in claim 2, wherein the guide projection comprises a substantially horizontal projection.

4. The backguide as recited in claim 1, wherein the elongated structure comprises a flat plate having a thickness of about 0.06 inches.

5. The backguide as recited in claim 1, further comprising at least one resilient mount for limiting the deflection of the backguide.

6. The backguide as recited in claim 1, wherein the elongated structure comprises at least one of a plate, a bar, a tube, and a rod.

7. The backguide as recited in claim 1, wherein the at least one substantially vertical baffle comprises a plurality of substantially vertical baffles.

8. The backguide as recited in claim 1, wherein the guide means is adapted to limit at least one of the horizontal deflection and the vertical deflection of the second end of the elongated structure.

9. The backguide as recited in claim 1, wherein the guide means comprises a resilient mounting.

10. The backguide as recited in claim 9, wherein the resilient mounting comprises at least one of a spring and an elastomeric element.

11. The backguide as recited in claim 1, wherein the backguide is adapted to be mounted to a conveyor.

12. The backguide as recited in claim 1, wherein the pivotally mounted first end of the elongated structure is adapted to vertically deflect.

13. The backguide as recited in claim 12, wherein the first end of the elongated structure comprises means for limiting vertical deflection of the first end.

14. The backguide as recited in claim 13, wherein the means for limiting vertical deflection of the first end comprises at least one resilient element.

15. The backguide as recited in claim 1, wherein backguide further comprises a rear restrictor assembly.

16. The backguide as recited in claim 1, wherein the backguide is adapted to deflect wherein the at least one substantially horizontal plate makes an angle $\alpha$ with the horizontal.

17. The backguide as recite in claim 16, wherein the substantially horizontal plate may be deflected in one of a clockwise and a counterclockwise direction.

18. The backguide as recited in claim 17, wherein the angle $\alpha$ is at least about 3 degrees.

19. The backguide as recited in claim 18, wherein the angle $\alpha$ is at least about 6 degrees.

20. A backguide for a hopper, the backguide adapted and positioned for feeding sheet material to a disk separator, the backguide comprising:

an elongated structure having a pivotally mounted first end and a second end;

at least one substantially vertical baffle mounted to the elongated structure for retaining sheet material in the hopper;

at least one substantially horizontal plate mounted to the elongated structure for supporting at least a portion of the sheet material fed to the hopper;

a guide means adapted to limit the deflection of the second end of the elongated structure; and a guide projection mounted to the second end of the elongated structure, wherein the guide means is adapted to engage the guide projection.

21. The backguide as recited in claim 20, wherein the guide projection comprises a substantially horizontal projection.

22. The backguide as recited in claim 20, wherein the guide means comprises a pair of spaced bars.

23. The backguide as recited in claim 20, wherein the backguide is adapted to deflect wherein the at least one substantially horizontal plate makes an angle $\alpha$ with the horizontal.

24. The backguide as recited in claim 20, wherein the guide means is adapted to limit at least one of the horizontal deflection and the vertical deflection of the second end of the elongated structure.

25. A backguide for a hopper, the backguide adapted and positioned for feeding sheet material to a disk separator, the backguide comprising:

an elongated structure having a pivotally mounted first end and a second end, wherein the pivotally mounted first end is adapted to vertically deflect;

at least one substantially vertical baffle mounted to the elongated structure for retaining sheet material in the hopper;

at least one substantially horizontal plate mounted to the elongated structure for supporting at least a portion of the sheet material fed to the hopper;

wherein the pivotally mounted first end further comprises means for limiting vertical deflection of the first end, the means for limiting vertical deflection of the first end comprising at least one resilient element, wherein the at least one resilient element comprises at least one spring.

26. A backguide for a hopper, the backguide adapted and positioned for feeding sheet material to a disk separator, the backguide comprising:

an elongated structure having a pivotally mounted first end and a second end;

at least one substantially vertical baffle mounted to the elongated structure for retaining sheet material in the hopper;

at least one substantially horizontal plate mounted to the elongated structure for supporting at least a portion of the sheet material fed to the hopper; and a rear restrictor assembly adjacent the first end;

wherein the rear restrictor assembly is adapted to vary the deflection of the backguide.

27. The backguide as recited in claim 26, wherein the rear restrictor assembly varies the deflection of the backguide as a function of the stiffness of the sheet material.

28. A backguide for a hopper, the backguide adapted and positioned for feeding sheet material to a disk separator, the backguide comprising:

an elongated structure having a pivotally mounted first end and a second end;

at least one substantially vertical baffle mounted to the elongated structure for retaining sheet material in the hopper;

at least one substantially horizontal plate mounted to the elongated structure for supporting at least a portion of the sheet material fed to the hopper; and a rear restrictor assembly, wherein the rear restrictor assembly comprises at least one restrictor plate mounted to the first end of the elongated structure.

29. The backguide as recite in claim 28, wherein the rear restrictor assembly further comprises at least one means for deflecting the restrictor plate.

30. The backguide as recited in claim 29, wherein the at least one means for deflecting the restrictor plate comprises at least one threaded shaft threadably mounted to the first end of the elongated structure.

* * * * *